US006512490B1

(12) United States Patent
Lee

(10) Patent No.: US 6,512,490 B1
(45) Date of Patent: Jan. 28, 2003

(54) PORTABLE SATELLITE ANTENNA

(75) Inventor: Dae-Il Lee, 302 Kumjung villa A, 220-2 Ducksoo7-ri, Wabu-eup, Namyangju-shi, Kyounggi-do (KR)

(73) Assignees: IDS Corporation, Seoul (KR); Dae-Il Lee, Kyounggi-do (KR)

( * ) Notice: Subject to any disclaimer, the term of this patent is extended or adjusted under 35 U.S.C. 154(b) by 0 days.

(21) Appl. No.: 10/014,510

(22) Filed: Dec. 14, 2001

(30) Foreign Application Priority Data

Dec. 4, 2001 (KR) ..... 2001-76117

(51) Int. Cl.[7] ..... H01Q 3/08; H01Q 1/34
(52) U.S. Cl. ..... 343/882; 343/758; 343/766
(58) Field of Search ..... 343/757, 758, 343/761, 765, 766, 878, 882; 342/359

(56) References Cited

U.S. PATENT DOCUMENTS 4,642,385 A * 2/1987 Jackman ..... 568/393
5,254,351 A * 10/1993 de Boer et al. ..... 426/23
5,517,204 A * 5/1996 Murakoshi et al. ..... 343/765
5,633,647 A * 5/1997 Tines ..... 343/766
6,023,247 A * 2/2000 Rodeffer ..... 343/765

* cited by examiner

*Primary Examiner*—Tan Ho
(74) *Attorney, Agent, or Firm*—McKenna Long & Aldridge LLP

(57) ABSTRACT

The present invention relates to a portable satellite antenna which is capable of implementing an accurate horizontal and vertical direction movement of a satellite antenna using a worm gear method and a screw type guide as a horizontal and vertical direction rotation unit of a satellite antenna and preventing an entangling phenomenon of an electric wire even when an antenna is rotated in a horizontal direction.

3 Claims, 6 Drawing Sheets

PORTABLE SATELLITE ANTENNA

BACKGROUND OF THE INVENTION

1. Field of the Invention

The present invention relates to a portable satellite antenna, and in particular to a portable satellite antenna which is capable of automatically setting a satellite antenna in a direction of a reference satellite at an initial operation stage, rotating and setting an antenna by tracing the position of a satellite in accordance with the DiseqC Protocol in the case that there is an external effect or a channel change, implementing an accurate horizontal and vertical movement of a satellite antenna using a worm gear type method and a screw type guide as a horizontal and vertical direction rotation unit of a satellite antenna and preventing an entangled state of an electric wire which connects a satellite antenna and a main substrate by implementing a horizontal direction rotation at a certain angle and then implementing an opposite direction rotation.

2. Description of the Background Art

Generally, a satellite antenna is capable of receiving various signals from an artificial satellite such as a video signal, audio signal, etc. and various data such as an internet content information. Therefore, the above satellite antenna is an important instrument for a satellite broadcast.

The conventional satellite antenna is generally installed at a certain portion of a building.

The satellite antenna is installed for the reason that the antenna is rotated in a direction of a certain position so that the antenna is in a horizontal state for thereby effectively receiving an information from the satellite.

If a certain user installs a satellite antenna at a certain position, there are many limits for installing the satellite antenna and receiving a satellite broadcast at the position using a portable type satellite antenna by another user.

In order to overcome the above problems, a portable satellite antenna which is easily carried by a user is used. However, the conventional portable satellite antenna has a very complicated structure for rotating the antenna in a vertical direction and a horizontal directing in orientation with the satellite. In a unit for rotating the antenna in a horizontal direction, a rotation plate is rotated endlessly based on a rotation direction of a motor by engaging the motor in a lower portion of the rotation plate in a vertical direction. Therefore, an electric wire which connects the antenna and main substrate is severely entangled. Therefore, it is impossible to change the position of the satellite antenna in a direction of the changed satellite based on the channel change when connecting the satellite to the settop box. In order to overcome the above problems, a control box is additionally connected to a satellite antenna for tracing the position of other satellites, so that the price is increased and the operation is not easy.

SUMMARY OF THE INVENTION

Accordingly, it is an object of the present invention to provide a portable satellite antenna which overcomes the above problems encountered in the conventional art.

It is another object of the present invention to provide a portable satellite antenna which is capable of setting a satellite antenna in a direction of a reference satellite at an initial operation stage, rotating and setting an antenna by tracing the position of a satellite in accordance with the DiseqC Protocol in the case that there is an external effect or a channel change, implementing an accurate horizontal and vertical movement of a satellite antenna using a worm gear type method and a screw type guide as a horizontal and vertical direction rotation unit of a satellite antenna and preventing an entangled state of an electric wire which connects a satellite antenna and a main substrate by implementing a horizontal direction rotation at a certain angle and then implementing an opposite direction rotation. To achieve the above objects, there is provided a portable satellite antenna which includes a rotation rod rotatably mounted on an upper surface of a support member formed on an upper surface of the rotation plate at a certain distance, a rotation gear being inserted onto the center of the rotation rod, a rotation piece downwardly protruded from an end portion of the antenna and engaged to both ends of the rotation rod for thereby rotating the antenna in upward and downward directions based on the rotation direction of the rotation rod, a first driving motor which has a rotary shaft onto which a worm gear is inserted for being engaged with the rotation gear, for thereby rotating the worm gear in the normal and reverse directions, a fixing gear installed on an upper center portion of the fixing plate, a rotor which is bearing-engaged to an upper portion of the fixing gear for thereby implementing an independent rotation thereof, a rotation plate being engaged to the upper portion of the rotor using a bolt, a guide which has a pair of guide protrusions are protruded in parallel from a lower surface of the rotation plate and is formed in a screw shape in the direction from an outer portion to the center of the rotation plate, so that a moving protrusion is moved between the guide protrusions when the rotation plate is rotated, a guide rod which is linearly formed on an upper surface of the fixing plate in the direction from the outer portion to the center, a moving protrusion which is movably inserted into the guide rod, has an upper end inserted between the guide protrusions of the guide, is moved along the guide when the rotation plate is rotated, and is linearly moved in the guide rod, a second driving motor which is downwardly installed in one side of the fixing gear, has a rotary shaft supported by the driving gear, and is driven by a control voltage supplied from a control unit for thereby rotating the driving gear in the normal and reverse directions, so that the rotation plate is rotated, and a control unit which stores a position information of the satellite including a reference satellite, controls the first driving motor and the second driving motor when an initial power is supplied, sets the antenna to be in the direction of the reference satellite, drives the second driving motor when a channel is changed or an external effect is inputted, and moves the antenna in a horizontal direction in the direction of a certain satellite in the satellite antenna in which a rotation plate is mounted in an upper portion of a fixing plate, and a casing having a satellite antenna is engaged to an upper portion of the rotating plate.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENTS

Figure 1:
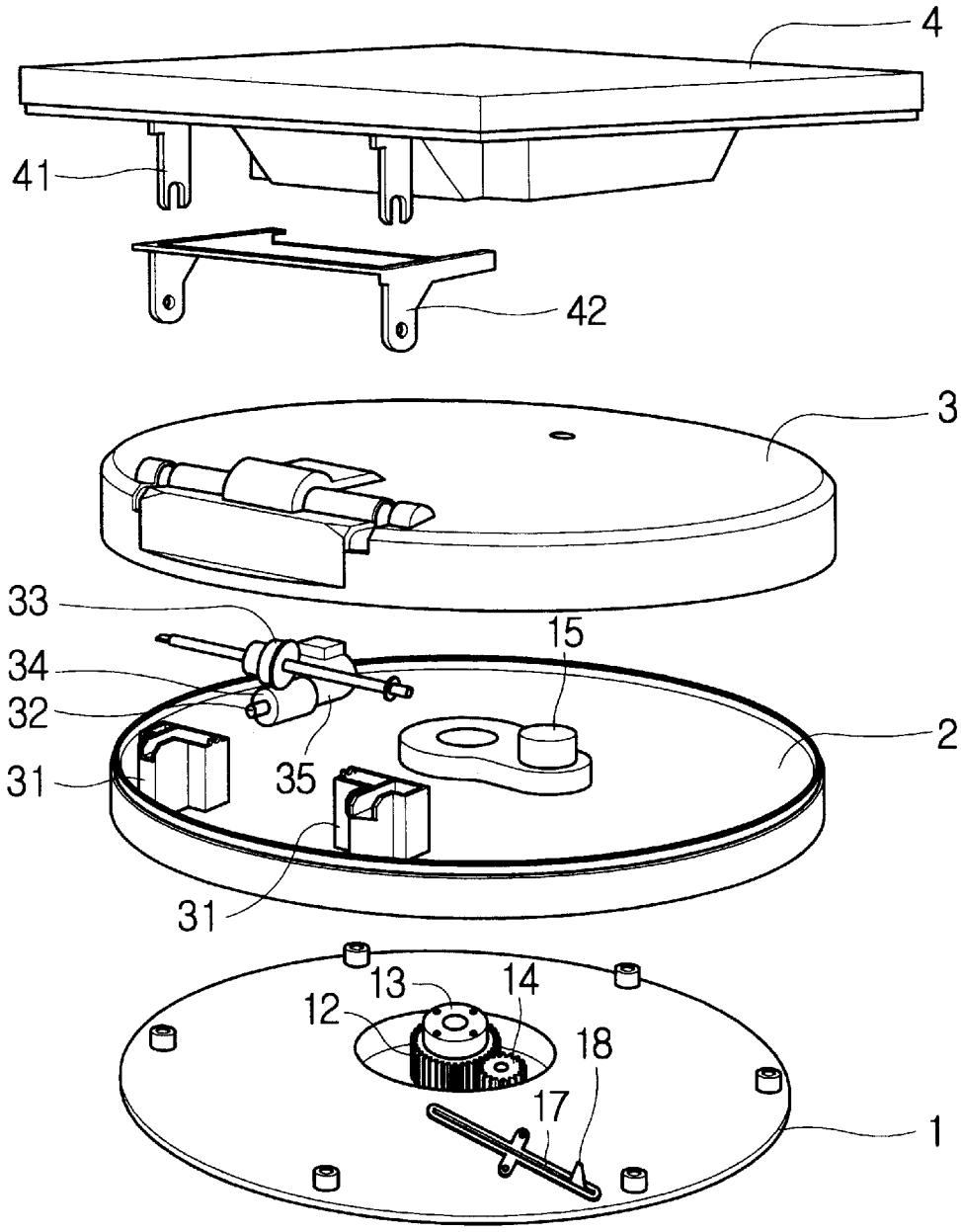
FIG. 1 is a disassembled perspective view illustrating a portable satellite antenna according to the present invention.
Figure 2:
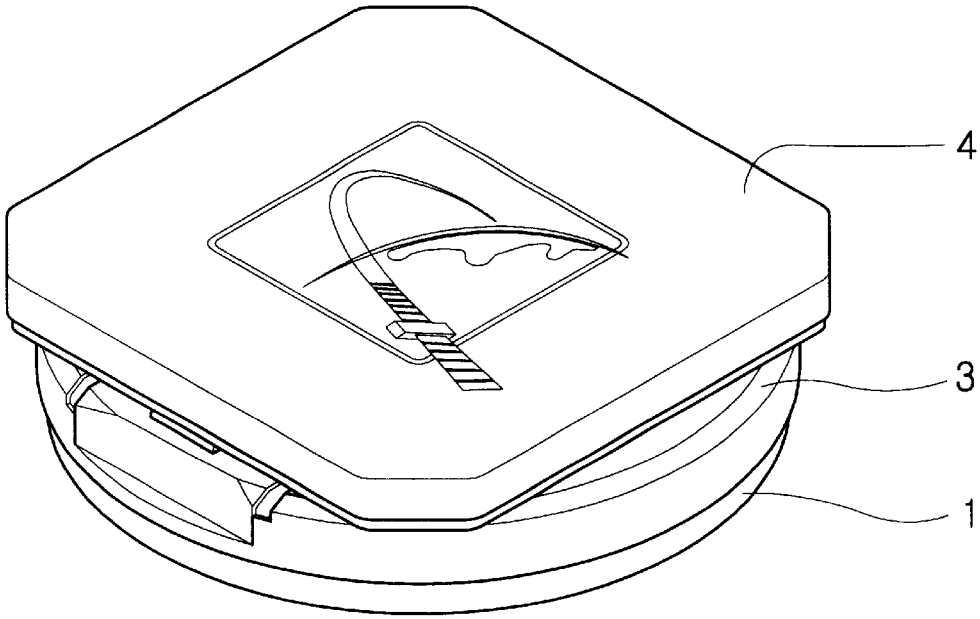
FIG. 2 is a perspective view illustrating a state that a portable satellite antenna is engaged according to the present invention.

The embodiments of the present invention will be explained with reference to FIGS. 1 through 6.

In a satellite antenna in which a rotation plate 2 is mounted in an upper portion of a fixing plate 1, and a casing 3 having a satellite antenna 4 is engaged to an upper portion of the rotation plate 2, a portable satellite antenna according to the present invention includes a rotation rod 32 rotatably mounted on an upper surface of a support member 31 formed on an upper surface of the rotation plate 2 at a certain distance, a rotation gear 33 being inserted onto the center of the rotation rod 32, a rotation piece 41 downwardly protruded from an end portion of the antenna and engaged to both ends of the rotation rod 32 for thereby rotating the antenna in upward and downward directions based on the rotation direction of the rotation rod 32, a first driving motor 35 which has a rotary shaft onto which a worm gear 34 is inserted for being engaged with the rotation gear 33, for thereby rotating the worm gear 34 in the normal and reverse directions, a fixing gear 12 installed on an upper center portion of the fixing plate 1, a rotor 13 which is bearing-engaged to an upper portion of the fixing gear 12 for thereby implementing an independent rotation thereof, a rotation plate 2 being engaged to the upper portion of the rotor 13 using a bolt, a guide 21 which has a pair of guide protrusions 24 are protruded in parallel from a lower surface of the rotation plate 2 and is formed in a screw shape in the direction from an outer portion to the center of the rotation plate 2, so that a moving protrusion 18 is moved between the guide protrusions 24 when the rotation plate 2 is rotated, a guide rod 17 which is linearly formed on an upper surface of the fixing plate 1 in the direction from the outer portion to the center, a moving protrusion 18 which is movably inserted into the guide rod 17, has an upper end inserted between the guide protrusions 24 of the guide 21, is moved along the guide 21 when the rotation plate 2 is rotated, and is linearly moved in the guide rod 17, a second driving motor 15 which is downwardly installed in one side of the fixing gear 12, has a rotary shaft 16 supported by the driving gear 14, and is driven by a control voltage supplied from a control unit for thereby rotating the driving gear 14 in the normal and reverse directions, so that the rotation plate 2 is rotated, and a control unit 8 which stores a position information of the satellite including a reference satellite, controls the first driving motor 35 and the second driving motor 15 when an initial power is supplied, sets the antenna to be in the direction of the reference satellite, drives the second driving motor 15 when a channel is changed or an external effect is inputted, and moves the antenna in a horizontal direction in the direction of a certain satellite.

The control unit 8 includes a distribution unit 82 for supplying a satellite signal from the antenna 4 to a settop box and supplying a channel information from the settop box to a tuner 83, a tuner 83 for supplying a channel information from the distribution unit 82 to a CWM modem 84 and a microprocessor 85, a CWM modem 84 for analyzing a channel information, encoding a satellite information corresponding to the channel in accordance with a DiseqC protocol and supplying to the microprocessor 85, a memory 86 for storing horizontal position information of the satellites 6 around the reference satellite 5, a microprocessor 85 which drives the first and second driving motors 35 and 15 in accordance with a position information of the reference satellite stored in the memory 86 when an initial power is inputted, sets the antenna 4 to be in the direction of the reference satellite 5 and drives the second driving motor 15 for thereby horizontally rotating the antenna 4 in the direction of the satellite 6 corresponding to the changed channel of the settop box based on the satellite information analyzed by the CWM modem 84 and the horizontal position information stored in the memory 86 when the channel is changed in the settop box, and a motor driving unit 87 for driving the first driving motor 35 and the second driving motor 15 in accordance with a control signal of the microprocessor 85.

There are further provided a first sensor 22 and a second sensor 23 installed at both ends of the guide 21 for detecting a state that the moving protrusion 18 is moved to a near portion and supplying a detection signal to the microprocessor 85 wherein when the antenna 4 is rotated in the horizontal direction, and the microprocessor 85 rotates the antenna 4 in the reverse direction at the time when the moving protrusion 18 is detected by one of the sensors 22 and 23 for thereby preventing an entangled state of an electric wire.

In the drawings, reference numeral 42 represents a reinforced plate formed of a metallic material butting with a lower side of the rotation plate 41.

The operation of the present invention will be explained as follows.

First, the engaging process will be described.

The antenna 4 capable of receiving a signal from a satellite is engaged on the upper surface of a casing 3 in such a manner that the antenna 4 is moved in a vertical direction. A rotation plate 2 is engaged to a lower side of the casing 3.

The rotation plate 2 is engaged to an upper side of the fixing plate 1. A horizontal rotation unit is installed between the fixing plate 2 and the antenna 4 for rotating the antenna 4 in a certain direction. A vertical rotation unit is installed between the rotation plate 2 and the casing 3 for rotating the antenna 4 in a vertical direction.

In the vertical rotation unit, a support member 31 is protruded on an upper potion of the rotation plate 2 at a certain distance. A rotation rod 32 is mounted in the support member 31, and a rotation gear 33 is formed in a center potion of a rotation rod 32. The rotation gear 33 is engaged with a worm gear 34 inserted onto a rotary shaft of a first driving motor 35.

A rotation piece 41 protruded from a lower portion of the antenna 4 is inserted into both ends of the rotation rod 32, so that the antenna is upwardly or downwardly moved in the vertical direction based on the rotation direction of the rotation rod 32.

In the horizontal rotation unit, as shown in FIG. 1, a certain size fixing gear 12 is installed in a mounting groove 11 formed on the upper center portion of the fixing plate 1. A rotator 13 is bearing-engaged on an upper surface of the fixing gear 12. The rotator 13 is independently rotatable in an upper portion of the fixing gear 12. The rotation plate 2 is bolt-engaged to the upper side of the rotator 13, so that the rotation plate 2 is rotatable together with the rotator 13.

Figure 3:
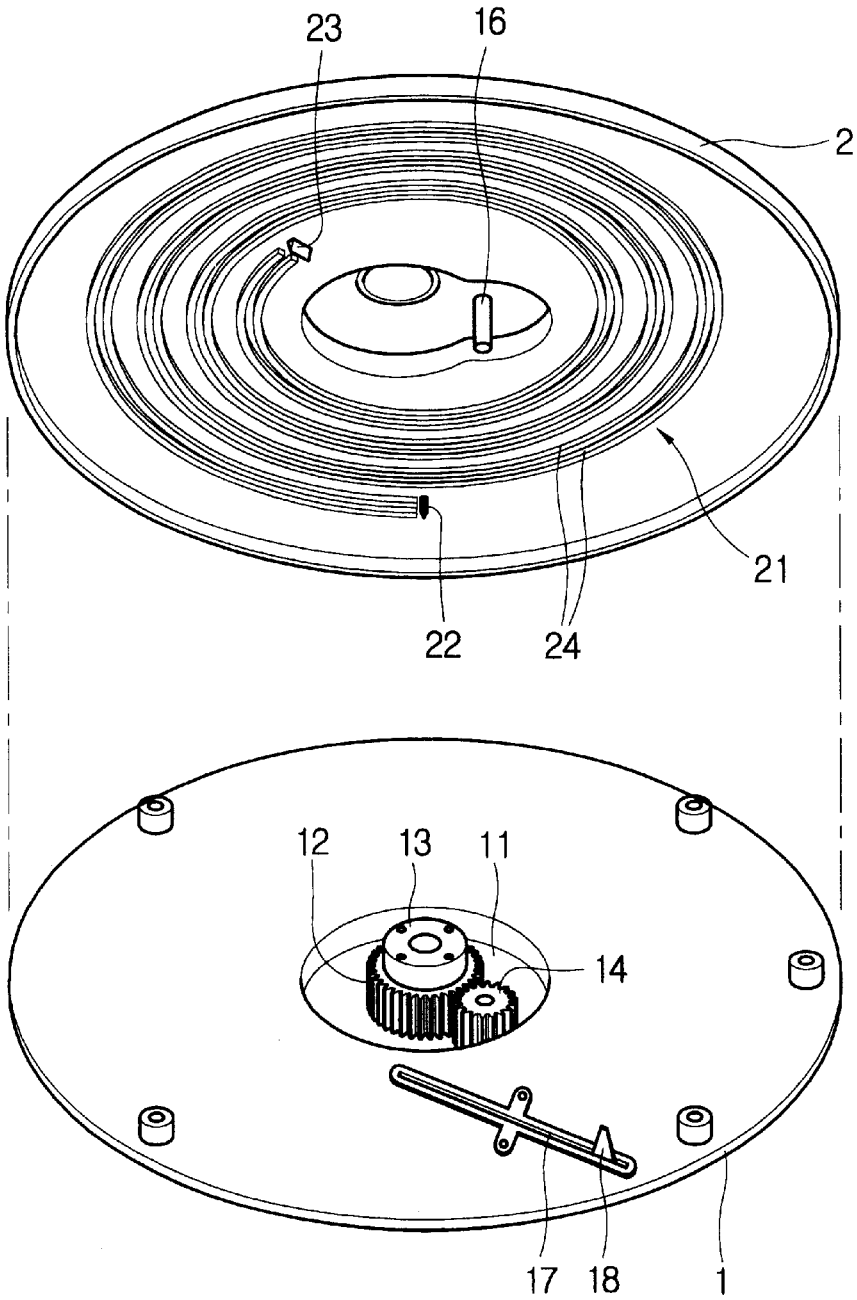
FIG. 3 is a disassembled perspective view illustrating a fixing plate and a rotation plate according to the present invention.
Figure 4:
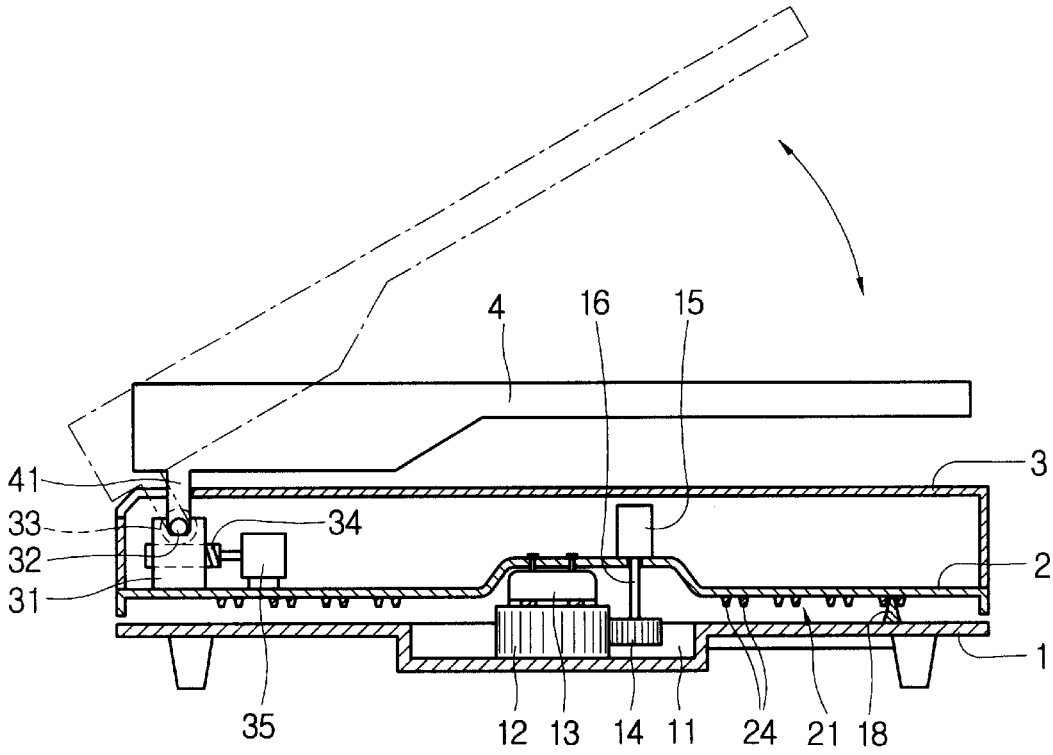
FIG. 4 is a cross-sectional view illustrating a portable satellite antenna according to the present invention.
Figure 5:
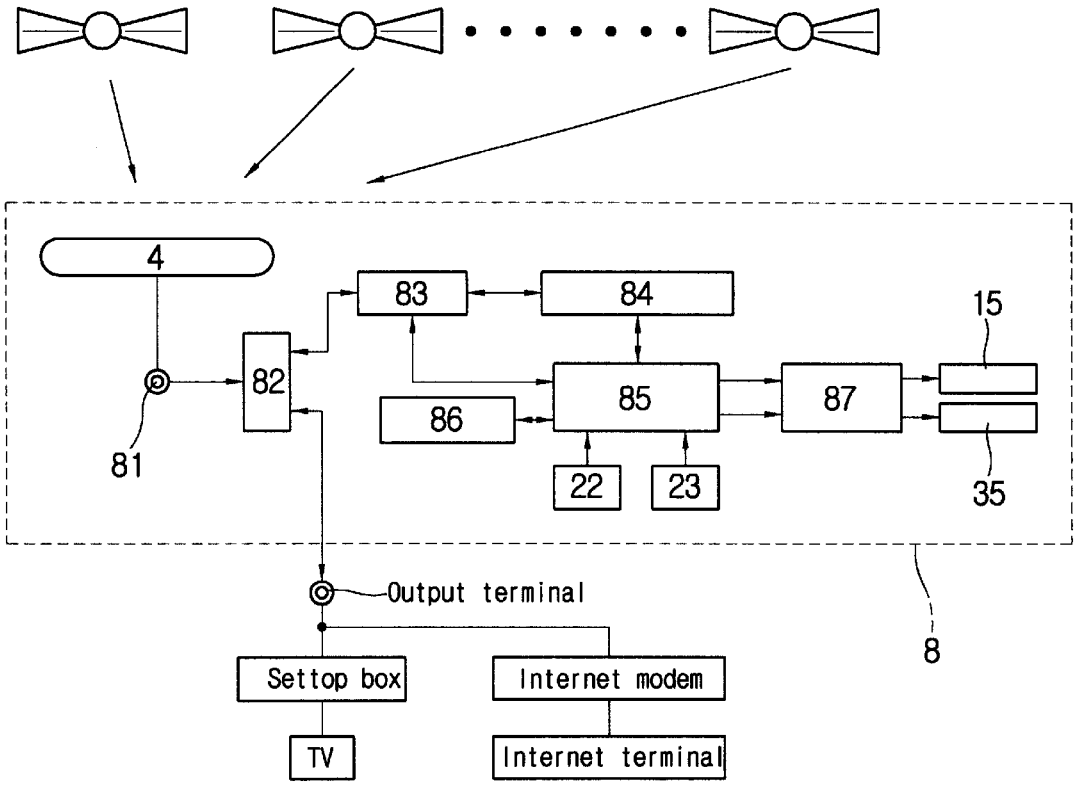
FIG. 5 is a block diagram illustrating a control unit according to the present invention.
Figure 6:
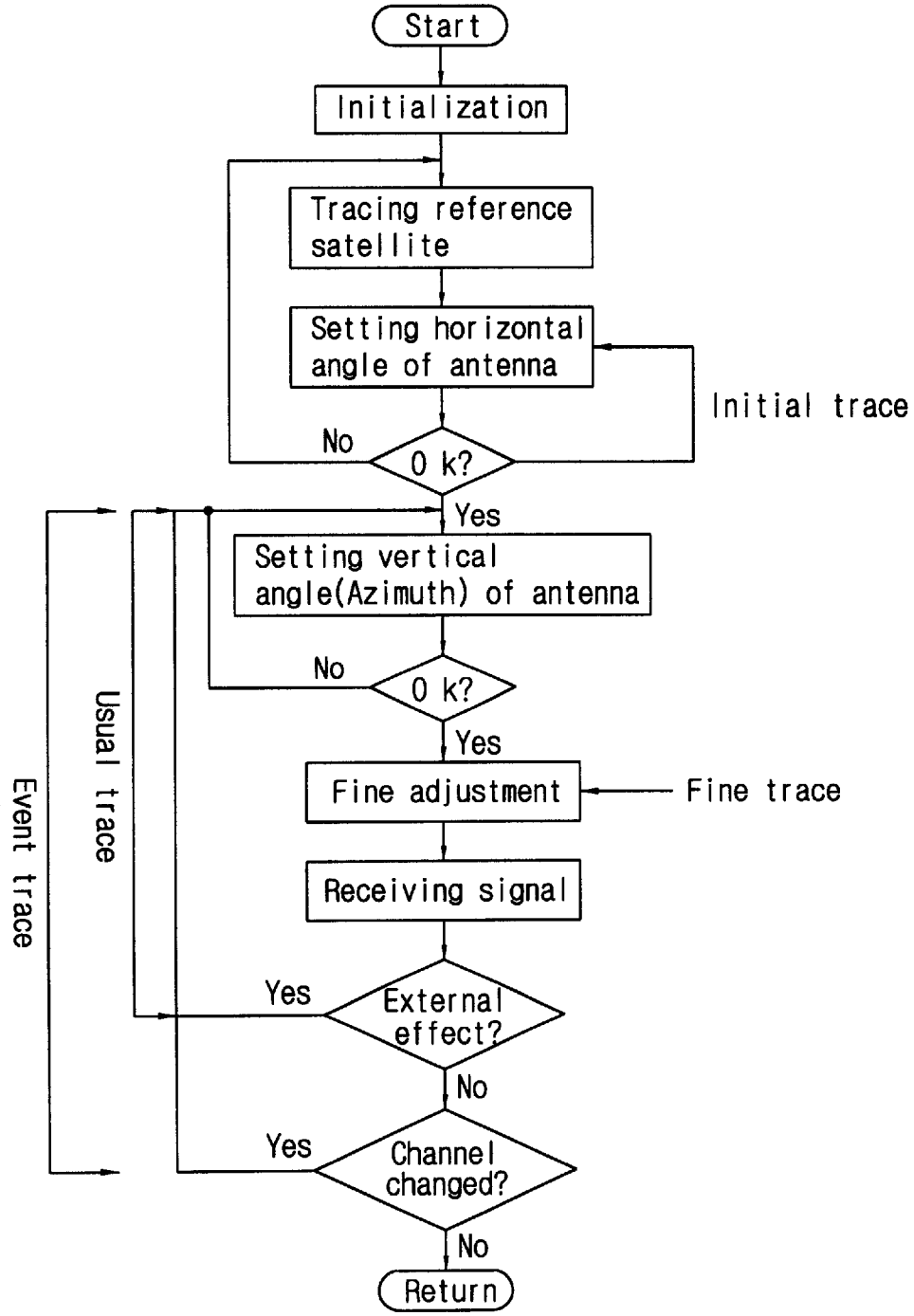
FIG. 6 is a flow chart of a control process of a portable satellite antenna according to the present invention.

In the center upper portion of the rotation plate 2, a second driving motor 15 is downwardly installed in a vertical direction. The rotary shaft 16 of the driving motor 15 is downwardly extended. A driving gear 14 is fixed to an end portion of the rotary shaft 16. As shown in FIG. 3, the driving gear 14 is engaged with an outer circumferential surface of the fixing gear 12 in such a manner that when a rotational force is transferred from the second driving motor 15, the driving gear 14 is rotated and is moved along an outer surface of the fixing gear 12, so that the rotation plate 2 is rotated based on the operation of the driving gear 14.

In the present invention, there are provided a guide 21, sensors 22 and 23 and a moving protrusion 18 for rotating the rotation plate 30 in a certain direction by a certain angle and then rotating the same in the reverse direction.

The guide 21 guides the movement of the moving protrusion 18 when the rotation plate 2 is rotated. As shown in FIG. 3, two protrusions 24 are protruded in parallel from the lower surface of the rotation plate 2. The guide protrusion 24 is moved from the outer portion of the rotation plate 2 to the inner side of the same for thereby forming a screw shape, and in a state that the moving protrusion 18 is inserted between the guide protrusions 24, the rotation plate 2 is rotated, and the moving protrusion 18 is moved between the guide protrusions 24 and is moved to a certain end portion.

A first sensor 22 and a second sensor 23 are installed at both ends of the guide 21, respectively. The first and second sensors 22 and 23 detect the moving protrusion 18 when the moving protrusion 18 which moves along the guide 21 is moved to a near portion and transfers the detected signal to a microprocessor 85 of a control unit 8.

The sensors 22 and 23 may detect the moving protrusions using a photo coupler. Any type sensor capable of detecting the moving protrusion which is moved to a near portion may be used.

The moving protrusion 18 is engaged in such a manner that the moving protrusion 18 is linearly moved on the guide rod 17 formed on the upper surface of the fixing plate 1. As shown in FIG. 3, the guide rod 17 is extended by a certain length from the outer portion of the fixing plate 1 to the center portion. The moving protrusion 18 is inserted into the guide rod 17 and is linearly movable.

The upper portion of the moving protrusion 18 is positioned between the guide protrusions 24 of the guide 21 in a state that the moving protrusion 18 is inserted into the guide rod 17.

Therefore, in a state that the moving protrusion 18 is positioned between the guide protrusions 24, when the rotation plate 2 is rotated, the moving protrusion 16 follows the guide 21 and is moved from the outer portion to the inner side or from the inner portion to the outer side in the guide rod 17.

For example, when the rotation plate 2 is rotated in the counterclockwise direction, the moving protrusion 18 is moved from the outer portion to the inner side of the guide 21 and is moved to an inner end portion of the guide 21, so that the second sensor 23 installed in the inner side detects the moving protrusion 18, and the detection signal is transferred to the microprocessor 85. The microprocessor 85 stops the counterclockwise direction rotation of the rotation plate 2.

Namely, After the moving protrusion 18 is detected by the second sensor 23, in a rotation operation in order for the antenna 4 to trace the satellite, the second driving motor 15 is driven for rotating the rotation plate 2 in the clockwise direction. At this time, the moving protrusion 18 is moved from the inner portion to the outer side of the guide 21.

When the moving protrusion 18 which is moved from the inner portion to the outer side is detected by the first sensor 22, the control unit drives the second driving motor 15 for rotating the rotation plate 2 in the counterclockwise direction, so that the antenna 4 traces the satellite.

When the antenna 4 traces the satellite in the above-described manner, since the rotation plate 2 is rotated in the normal and reverse directions based on a repeated manner, the electric wires which connect the antenna and the main substrate are not entangled for thereby enhancing a reliability with respect to the performance of the product.

The operation of the present invention will be described as follows.

In the satellite antenna according to the present invention, an output terminal is connected with the settop box connected with the television.

In the above state, when a power is supplied to the settop box and the satellite antenna, respectively, the microprocessor 85 drives the second driving motor 15 using a position information of the reference satellite 5 stored in the memory 86 and enables the antenna 4 to be rotated in the horizontal direction and moves the antenna 4 in the direction of the reference satellite 5. Thereafter, the microprocessor 85 drives the first driving motor 35 and moves the antenna 4 so that the antenna 4 most effectively receives the signals from the reference satellite 5 at an optimum angle.

When the initial setting operation is finished in the above manner, the antenna 4 receives the signals from the reference satellite 5, and the frequency bandwidth of the satellite signal received through the antenna 4 is downed based on the LNB 81 and is supplied to a distribution unit 82. The distribution unit 82 supplies the satellite signal to the settop box through the output terminal. The signals are displayed on the television.

If the direction of the antenna is moved by the weather condition or an external effect at the time when the antenna 4 receives the satellite signals, the microprocessor 85 drives the first driving motor 35 and tunes the vertical angle of the antenna 4, so that the antenna 4 is set for most effectively receiving the signals from the satellite.

In addition, if a user changes the channel of the television, the channel change signal is outputted to the settop box and is supplied to the tuner 83 through the distribution unit 82. The tuner 83 supplies the channel change signal to the CWM modem 84 and the microprocessor 85.

The CWM modem 84 analyzes the channel change signal in accordance with the diseqC Protocol and encodes the satellite information corresponding to the changed channel and transfers to the microprocessor 85. The microprocessor 85 drives the first driving motor 35 for moving the antenna 4 in the direction of the satellite 6 in accordance with a satellite information and a position information of the satellite stored in the memory 86 for thereby changing the vertical angle of the antenna 4.

Therefore, the antenna 4 implements an accurate position control with respect to the channel-changed satellite for thereby receiving a desired satellite signal.

The portable satellite antenna according to the present invention may be connected to the TV settop box and the internet modem of the internet terminal through the satellite.

As described above, the portable satellite antenna according to the present invention is capable of automatically setting a satellite antenna in a direction of a reference satellite at an initial operation stage, rotating and setting an antenna by tracing the position of a satellite in accordance with the DiseqC Protocol in the case that there is an external effect or a channel change, implementing an accurate horizontal and vertical movement of a satellite antenna using a worm gear type method and a screw type guide as a horizontal and vertical direction rotation unit of a satellite antenna and preventing an entangled state of an electric wire which connects a satellite antenna and a main substrate by implementing a horizontal direction rotation at a certain angle and then implementing an opposite direction rotation.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. In a satellite antenna in which a rotation plate is mounted in an upper portion of a fixing plate, and a casing having a satellite antenna is engaged to an upper portion of the rotating plate, a portable satellite antenna comprising:

a rotation rod rotatably mounted on an upper surface of a support member formed on an upper surface of the rotation plate at a certain distance, a rotation gear being inserted onto the center of the rotation rod;

a rotation piece downwardly protruded from an end portion of the antenna and engaged to both ends of the rotation rod for thereby rotating the antenna in upward and downward directions based on the rotation direction of the rotation rod;

a first driving motor which has a rotary shaft onto which a worm gear is inserted for being engaged with the rotation gear, for thereby rotating the worm gear in the normal and reverse directions;

a fixing gear installed on an upper center portion of the fixing plate;

a rotor which is bearing-engaged to an upper portion of the fixing gear for thereby implementing an independent rotation thereof, a rotation plate being engaged to the upper portion of the rotor using a bolt;

a guide which has a pair of guide protrusions are protruded in parallel from a lower surface of the rotation plate and is formed in a screw shape in the direction from an outer portion to the center of the rotation plate, so that a moving protrusion is moved between the guide protrusions when the rotation plate is rotated;

a guide rod which is linearly formed on an upper surface of the fixing plate in the direction from the outer portion to the center;

a moving protrusion which is movably inserted into the guide rod, has an upper end inserted between the guide protrusions of the guide, is moved along the guide when the rotation plate is rotated, and is linearly moved in the guide rod;

a second driving motor which is downwardly installed in one side of the fixing gear, has a rotary shaft supported by the driving gear, and is driven by a control voltage supplied from a control means for thereby rotating the driving gear in the normal and reverse directions, so that the rotation plate is rotated; and a control means which stores a position information of the satellite including a reference satellite, controls the first driving motor and the second driving motor when an initial power is supplied, sets the antenna to be in the direction of the reference satellite, drives the second driving motor when a channel is changed or an external effect is inputted, and moves the antenna in a horizontal direction in the direction of a certain satellite.

2. The antenna of claim 1, wherein said control means includes:

a distribution unit for supplying a satellite signal from the antenna to a settop box and supplying a channel information from the settop box to a tuner;

a tuner for supplying a channel information from the distribution unit to a CWM modem and a microprocessor;

a CWM modem for analyzing a channel information, encoding a satellite information corresponding to the channel in accordance with a DiseqC protocol and supplying to the microprocessor;

a memory for storing horizontal position information of the satellites around the reference satellite;

a microprocessor which drives the first and second driving motors in accordance with a position information of the reference satellite stored in the memory when an initial power is inputted, sets the antenna to be in the direction of the reference satellite and drives the second driving motor for thereby horizontally rotating the antenna in the direction of the satellite corresponding to the changed channel of the settop box based on the satellite information analyzed by the CWM modem and the horizontal position information stored in the memory when the channel is changed in the settop box; and a motor driving unit for driving the first driving motor and the second driving motor in accordance with a control signal of the microprocessor.

3. The antenna of claim 1, further comprising a first sensor and a second sensor installed at both ends of the guide for detecting a state that the moving protrusion is moved to a near portion and supplying a detection signal to the microprocessor wherein when the antenna is rotated in the horizontal direction, said microprocessor rotates the antenna in the reverse direction at the time when the moving protrusion is detected by one of the sensors for thereby preventing an entangled state of an electric wire.

* * * * *